US007730903B2

(12) United States Patent
Lindblom et al.

(10) Patent No.: US 7,730,903 B2
(45) **Date of Patent: *Jun. 8, 2010**

(54) NON-METALLIC AUXILIARY TANK SYSTEM FOR A VEHICLE

(75) Inventors: Thomas G. Lindblom, Claremont, MN (US); Keith A. Kruckeberg, Owatonna, MN (US); Ryan J. Roudebush, Byron, MN (US); Kevin M. Shaber, Rochester, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/509,609

(22) Filed: Jul. 27, 2009

(65) Prior Publication Data

US 2009/0283530 A1 Nov. 19, 2009

Related U.S. Application Data

(63) Continuation of application No. 11/657,351, filed on Jan. 24, 2007, now Pat. No. 7,581,557.

(51) Int. Cl.

| | |
|---|---|
| ***B28C 5/42*** | (2006.01) |
| ***B28C 7/14*** | (2006.01) |
| *B01F 15/00* | (2006.01) |

(52) U.S. Cl. ..... 137/259; 137/558; 366/138

(58) Field of Classification Search ..... 137/259, 137/264, 558; 73/311; 220/23.4, 23.6, 4.12, 220/4.13; 366/138

See application file for complete search history.

(56) References Cited

U.S. PATENT DOCUMENTS

| | | | | |
|---|---|---|---|---|
| 2,748,793 | A * | 6/1956 | Hilkemeier | 137/264 |
| 3,168,904 | A * | 2/1965 | Conover | 137/558 |
| 3,310,293 | A * | 3/1967 | Zimmerman | 366/6 |
| 3,638,485 | A * | 2/1972 | Knauth | 73/311 |
| 3,658,204 | A * | 4/1972 | Bottger | 220/23.4 |
| 4,629,087 | A * | 12/1986 | Lenz | 220/4.14 |
| 5,476,146 | A * | 12/1995 | Brown | 169/24 |
| 6,026,974 | A * | 2/2000 | Burt | 220/23.4 |
| 6,155,277 | A * | 12/2000 | Barry | 134/104.4 |
| 6,464,094 | B2 * | 10/2002 | Zacharias | 220/4.12 |
| 7,581,557 | B2 * | 9/2009 | Lindblom et al. | 137/259 |
| 2002/0185180 | A1 * | 12/2002 | Smith et al. | 137/565.17 |
| 2007/0189108 | A1 * | 8/2007 | Lindblom et al. | 366/30 |

* cited by examiner

*Primary Examiner*—John Rivell
(74) *Attorney, Agent, or Firm*—Nikolai & Mersereau, P.A.; C. G. Mersereau

(57) ABSTRACT

An on-board auxiliary split tank system for supplying makeup water and chemical additives to a transit concrete mixing vehicle is disclosed which includes a generally cylindrical water tank designed for generally horizontal deployment having a shaped recess therein and an additive tank configured to nest in said recess of said water tank and which, when nested in said recess, generally completes said cylindrical shape. The water tank and additive tank are formed from a non-metallic material comprising a polymeric component.

16 Claims, 6 Drawing Sheets

NON-METALLIC AUXILIARY TANK SYSTEM FOR A VEHICLE

CROSS-REFERENCED TO RELATED APPLICATIONS

This application is a continuation of application Ser. No. 11/657,351, filed Jan. 24, 2007, now U.S. Pat. No. 7,581,557, issued Sep. 1, 2009.

STATEMENT REGARDING FEDERALLY SPONSORED RESEARCH OR DEVELOPMENT

Not applicable

BACKGROUND OF THE INVENTION

I. Field of the Invention

The present invention relates generally to vehicle-mounted concrete mixing and dispensing systems and, more particularly, to on-board auxiliary fluid supply systems employed to supply water for washout or adding water and/or chemical additive to a concrete mix. Specifically, the present invention relates to a lightweight two-chamber split auxiliary tank for a fluid supply system that enables the addition of water and/or chemical additives from a compact two-chamber on-board supply.

II. Related Art

Transit concrete mixing trucks, sometimes referred to as ready-mix trucks, have long been in use. They are equipped with large chassis-mounted rotatable mixing drums for mixing and dispensing a quantity of concrete. The drums typically are mounted on an incline and have an opening in the upper end for receiving ingredients to be mixed and discharging mixed concrete products. Loading is accomplished through a charge hopper which extends a distance into the opening of the drum. The drum is further provided with internal helical flights or fins extending around its internal surface which act to propel material forward and mix the concrete ingredients when the drum is caused to rotate in one direction and cause the mixed concrete to be discharged from the opening when the rotation of the drum is reversed. The upper portion of the drum includes a ring and roller system for drum support and rotation that is carried by a heavy pedestal support assembly.

The trucks are often further equipped with auxiliary water supply systems including tanks carried on the truck. These systems are necessary for several reasons. After mixing and discharge, the mixing drums retain an amount of residual concrete on the mixing fins and inner drum surface and discharge chutes which needs to be periodically washed out to prevent it from curing and hardening in situ inside the drum and on external chutes. Therefore, it has become part of the operating routine to wash the interior of the drum and the discharge chutes one or more times per day. In addition, it is routinely necessary to add additional makeup water and/or amounts of chemical additives to concrete batches mixed in the drum prior to discharge.

In conjunction with the use of makeup or washout water on transit concrete mixing trucks, it has further become a common practice to provide a water supply on the vehicle. The auxiliary water supply has included a water tank that has been typically pressurized to 50 psi or higher by a supply of air from a compressor carried on the truck. This, in turn, supplies water under pressure for washout or other uses through hoses and a valving system in a well-known manner. Alternatively, more recently, the pressurized system may be replaced by a pump assembly which eliminates the need to pressurize the tank. Such a system is illustrated and described in co-pending application Ser. No. 11/355,049, entitled Auxiliary Water Tank and Pump Assembly For a Vehicle, filed Feb. 15, 2006. That application is deemed incorporated herein by reference in its entirety for any purpose.

To date, auxiliary water tanks that have been used have been rather heavy metal structures which both are heavy and may add corrosion problems to the system. While aluminum tanks may reduce weight and corrosion problems, they remain relatively more expensive which is an additional drawback. In addition, with prior tanks it has been necessary to provide a separate facility to store and dispense chemical additives which are often necessary to be added to a mix at a job site.

Thus, there remains a need for an on-board auxiliary water/chemical additive supply and storage system that includes container that are relatively lightweight and inexpensive, which do not corrode and which can provide an easy-to-use, on-board supply of both water and chemical additives.

SUMMARY OF THE INVENTION

In accordance with an important aspect of the present invention, there is provided an on-board auxiliary split tank system for supplying makeup water and chemical additives to a transit concrete mixer truck. The auxiliary split tank system is fabricated of a polymeric material that is relatively lightweight and which will remain stable over time. In accordance with another aspect of the invention, the auxiliary water/chemical supply tank system is a composite of two separate containers, also known as a "split design", in which a separate, rather smaller chemical additive compartment nests in a matching recess in the rather larger molded water tank. Both compartments may be and are preferably designed as top discharge, bottom draw output systems which include draw tubes which are designed to connect to an external pumping system such as are illustrated and described in the above-referenced co-pending application.

Embodiments of both the water tank compartment and the chemical additive tank preferably are provided with liquid level indicators which may be transparent site gauges with floating indicators and which may be calibrated in terms of volume and the larger water compartment may be provided with single or dual fill capabilities. A composite split tank is preferably designed to be mounted on a spaced hardware saddle held in place by heavy straps made of high strength polymer materials such as nylon. A gripping surface may be provided under the strap location such as by molding teeth into the corresponding surfaces of the tanks. The chemical additive tank may be held in a nesting position in the recess in the water compartment by the straps.

BRIEF DESCRIPTION OF THE DRAWINGS

In the drawings, wherein like reference characters are used to designate corresponding parts throughout the several views.

DETAILED DESCRIPTION

The following represents a detailed description of an embodiment embracing the basic concepts of the present invention. The described embodiment is presented as a representative example of the invention and is not meant to limit the scope of the concept in any respect.

Figure 1:
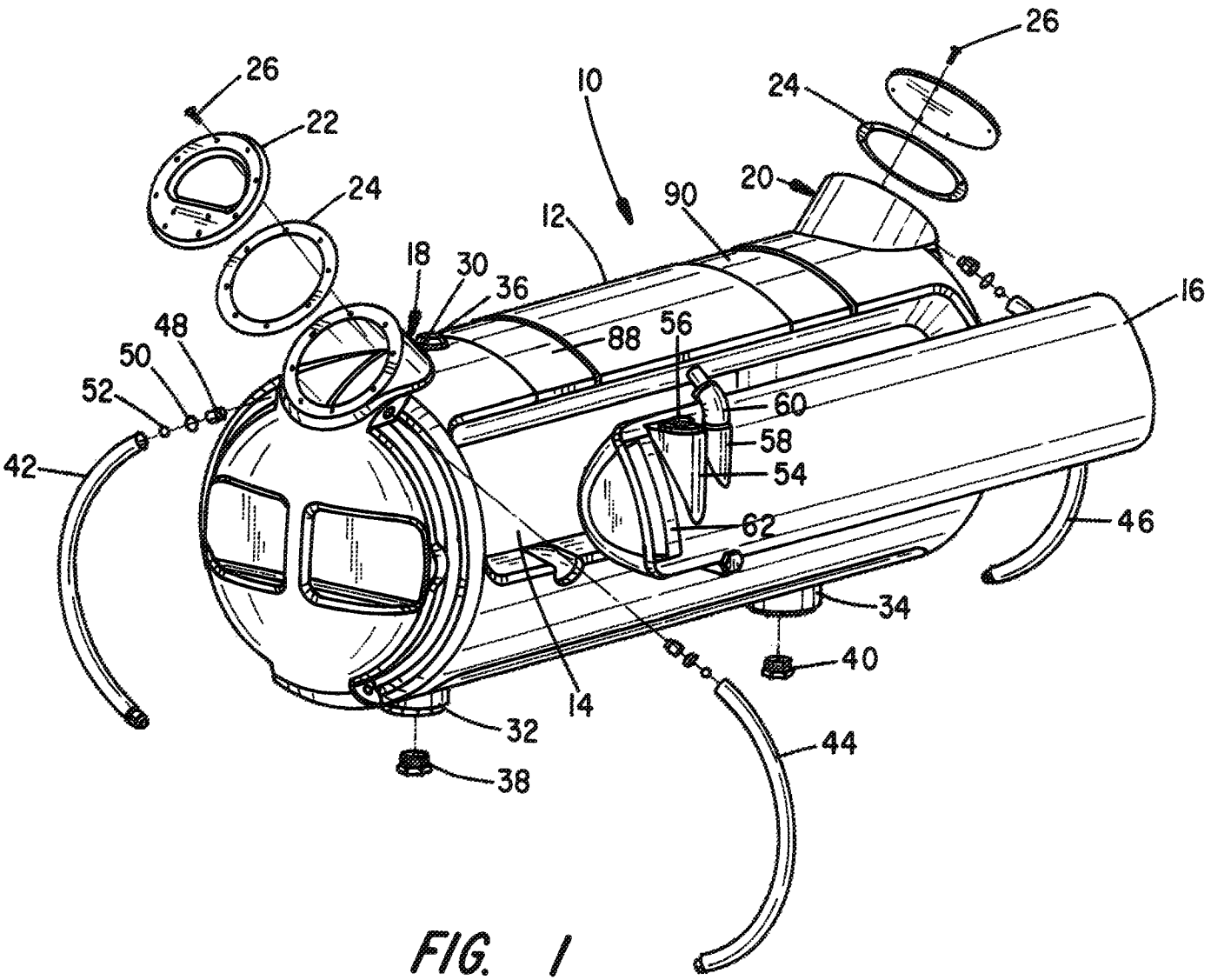
FIG. 1 is an exploded perspective view of one embodiment of an auxiliary split tank system in accordance with the invention.
Figure 2:
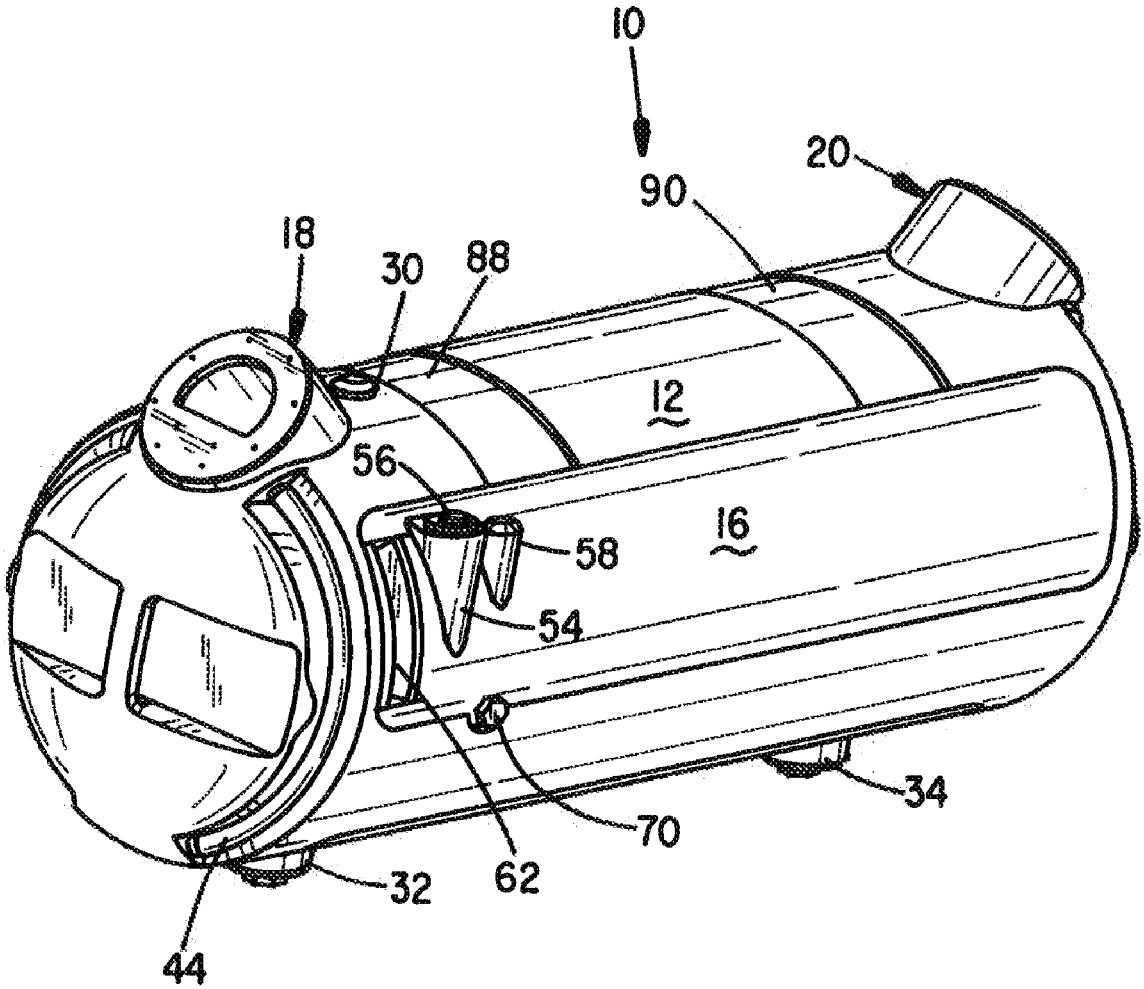
FIG. 2 is a perspective assembled view of the auxiliary split tank system of FIG. 1.

FIGS. 1 and 2 depict, respectively, a broken apart and an assembled auxiliary split tank system for supplying makeup water and chemical additives to the mixing drum of a transit concrete mixer. The tank system is represented generally by the reference character 10 and includes a generally cylindrical rather larger main water tank 12 designed for mounting in a generally horizontal disposition and including a shaped recess at 14. An additive tank 16 configured to nest in the recess 14 in the main water tank 12 is provided. As shown in FIG. 2, when the additive tank 16 is nested in the recess 14, it generally completes a cylindrical shape for the auxiliary split tank system.

The main tank 12 further includes a pair of upper accesses 18 and 20, one of which is a quick fill molded polymer or rubber flopper valve assembly 22 for filling and sealing the tank and drawing in replacement air, which includes a gasket 24 and is suitably bolted by fasteners as at 26. The other access 20 includes a cover 28 and a gasket 24. The fill and sealed access parts are interchangeable as desired. Further external accesses for pump suction connection and/or drain are shown at 30, 32 and 34, shown with respective seals or plugs at 36, 38 and 40. The main tank 12 is further provided with liquid level indicator hoses 42, 44 and 46 with suitable connection fittings including barbs 48, clamps 50 and level indicator balls 52.

Figure 3A:
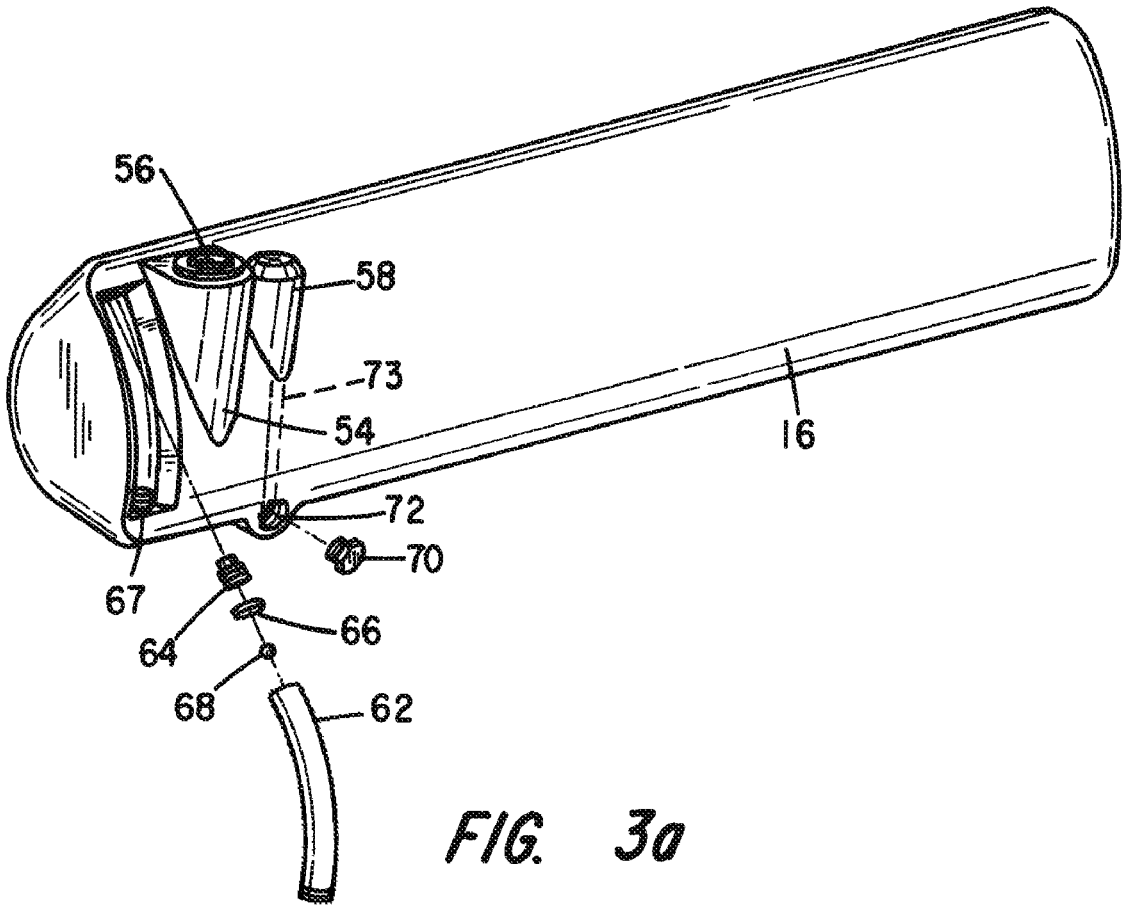
FIG. 3*a* depicts an exploded perspective view of a chemical additive tank of the auxiliary split tank system of the invention.
Figure 3B:
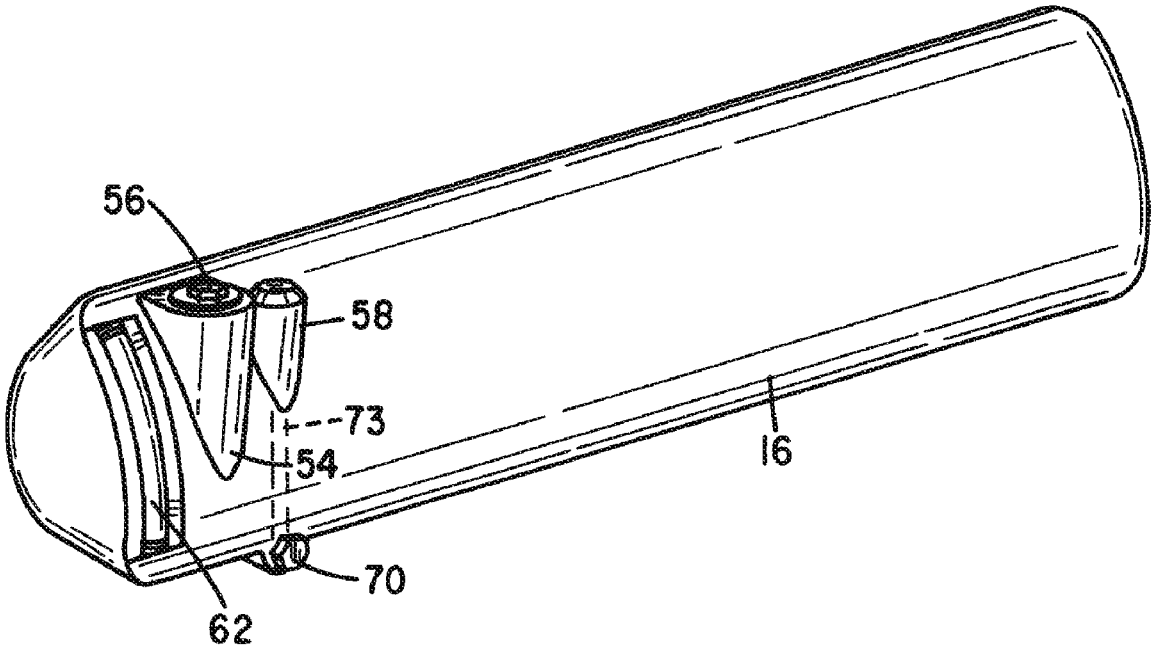
FIG. 3*b* is an assembled view of the chemical additive tank of FIG. 3*a;*

The additive tank 16 also includes upper access 54, with vented fill cap 56 and access 58 with connection at 60. A liquid level indictor hose 62 which, as shown in the exploded view of FIG. 3*a*, includes barbs 64, clamps 66 and level indicator ball 68. A drain plug is shown at 70 for a drain opening 72. The additive tank further includes a bottom draw line shown in phantom at 73 and a vented fill cap at 74.

Figure 4A:
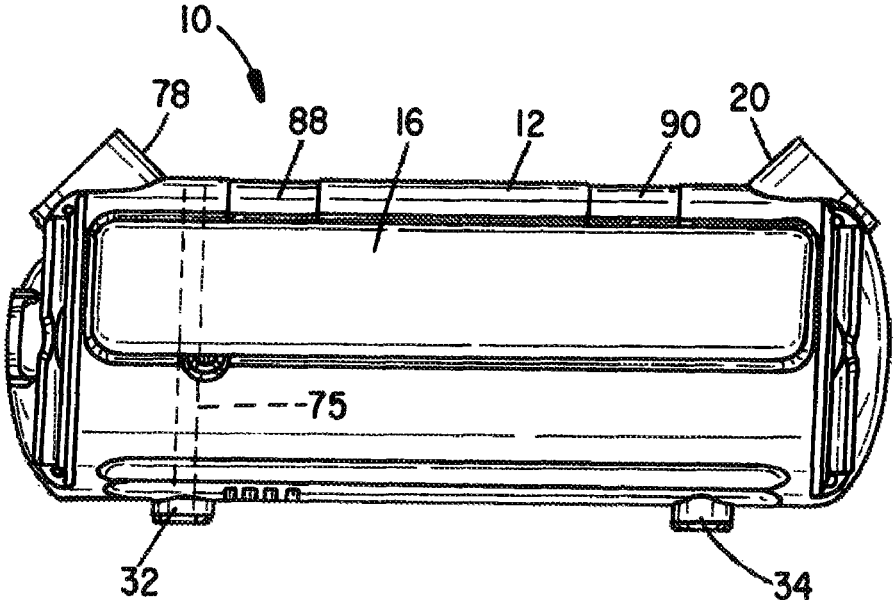
FIGS. 4*a* and 4*b* are side and bottom views, respectively, of the embodiment of FIGS. 1 and 2.
Figure 4B:
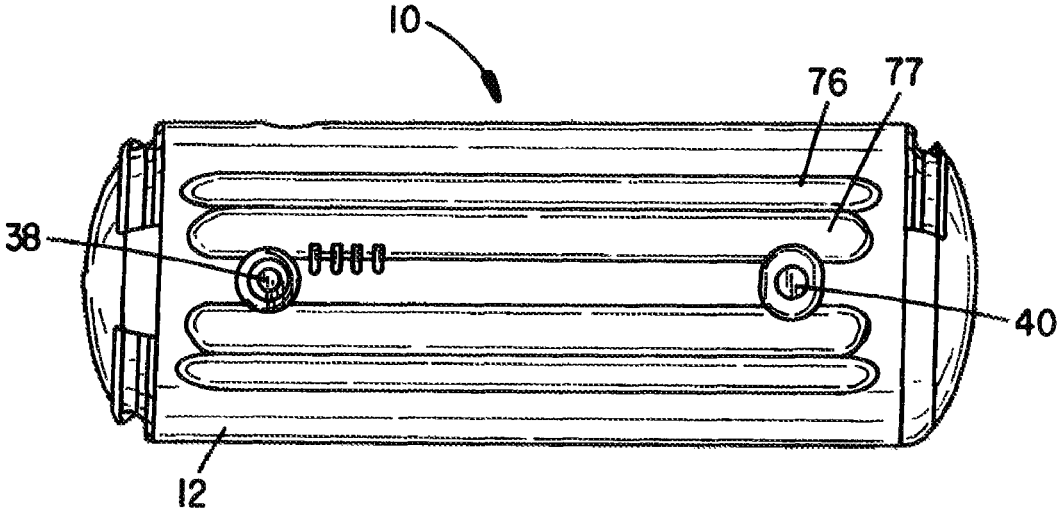

FIGS. 4*a* and 4*b* are respectively side and bottom views of the embodiment of FIGS. 1 and 2 also showing a bottom draw line in phantom at 75 and reinforcing ribs in the structure at 76 and 77.

An optional tank lever sleeve for limiting the fill volume of the tank may also be provided, if desired, in a well known manner.

Access 30 is designed to accommodate a draw tube mounted from the opening which also accommodates a flexible PVC insert for connection to an external pump (FIG. 5) and distribution system in a well-known manner (not shown).

Figure 5:
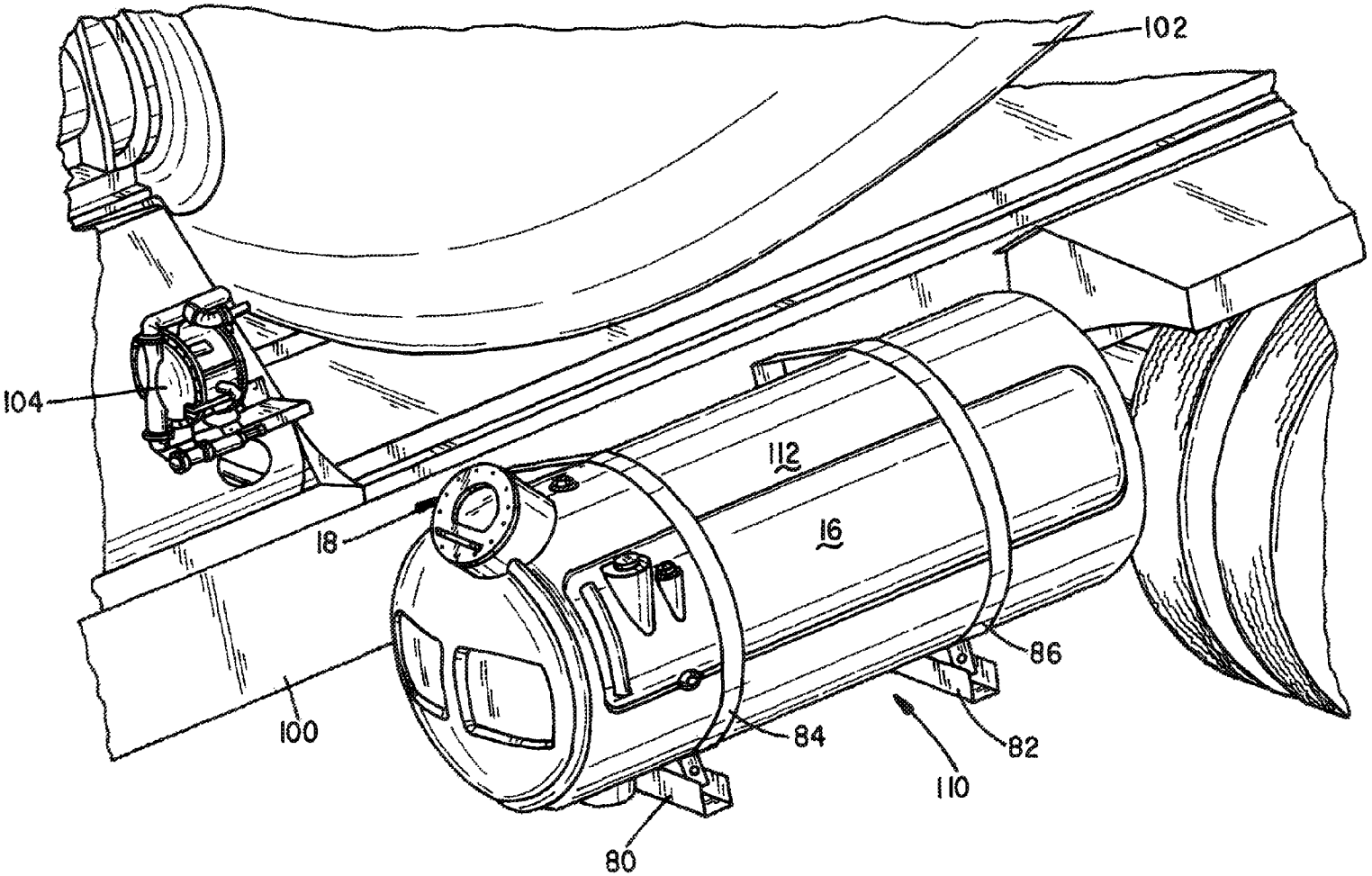
FIG. 5 is a perspective view showing an embodiment of the split tank system of the invention mounted to a transit concrete mixer truck.

In FIG. 5, the auxiliary split tank system 10 is shown mounted on a pair of saddles or skids 80 and 82 fixed in place by a pair of heavy mounting straps 84 and 86, respectively. Part of the area under the straps as at 88 and 90 may be provided with molded gripping teeth, or the like, to aid in retention of the tanks. The chemical additive tank 16 is retained in the recess 14 of tank 12 by the straps 84 and 86. FIG. 5 depicts the auxiliary split tank system as a side mount to a chassis member 100 of a transit concrete mixer shown as a partial fragment and including a mixing drum fragment 102. A pump is shown at 104 to which the outputs of the tanks 12 and 16 can be connected for distribution of the contents as required.

The tanks 12 and 16 may be molded of any stable, relatively high strength polymer material such as, for example, high density polyethylene (HDPE). Successful models have been molded from high density polyethylene (HDPE) and this may be a preferred material. Other materials which are tough, chemically inert to the contents and can withstand outdoor temperature swings would also be suitable. The straps 84 and 86 are also preferably a high strength plastic material such as a polyamide, particularly a nylon.

The tanks 12 and 16 may be made any convenient size and in one typical embodiment, the main the water tank 12 is one with 135-gallon (511.3 liters) capacity. The chemical additive tank was 15 gallons (56.78 liters).

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An on-board auxiliary split tank system for supplying makeup water and chemical additives to a transit concrete mixing vehicle comprising:

(a) a generally cylindrical main water tank designed for generally horizontal deployment defining a water compartment and having a shaped external recess therein;

(b) an additive tank configured to nest in said recess of said main water tank and defining an additive chamber and which, when nested in said recess, generally completes said cylindrical shape;

(c) wherein said water tank and said additive tank are formed from a non-metallic material comprising a polymeric component;

(d) wherein said water tank and said additive tank include integral external liquid level indicators;

(e) a mounting system for attaching said split tank system to a transit concrete mixing vehicle chassis; and (f) wherein said tanks are retained together by high strength polymeric straps, and wherein said mounting system includes said straps.

2. A tank system as in claim 1 wherein said water tank and said additive tank are top discharge, bottom draw tanks and include bottom draw wells with draw tubes and drain outlets.

3. A tank system as in claim 1 wherein said liquid level indicators are tube-type indicators.

4. A tank system as in claim 3 wherein said additive tank liquid level indicator includes calibrations indicating volumetric content thereof for volume measurement.

5. A tank system as in claim 3 wherein said liquid level indicators for both said main tank and said additive tank include calibrations indicating volumetric content for volume measurement.

6. A tank system as in claim 1 wherein said polymer component comprises a high density polyethylene.

7. A tank system as in claim 5 wherein said polymer component comprises high density polyethylene.

8. A tank system as in claim 1 wherein said main water tank includes a pair of spaced fill openings.

9. A tank system as in claim 1 wherein said main water tank includes a bottom drain outlet.

10. A tank system as in claim 1 wherein said polymeric straps include nylon.

11. A tank system as in claim 1 mounted on a transit concrete mixer vehicle.

12. A tank system as in claim 1 wherein said tank system is designed to be attached to the outside of a vehicle chassis member.

13. A tank system as in claim 1 wherein said tanks are provided with molded gripping teeth in an area under said straps.

14. An on-board auxiliary split tank system for supplying makeup water and chemical additives to a transit concrete mixing vehicle comprising:

(a) a generally cylindrical main water tank designed for generally horizontal deployment defining a water compartment and having a shaped external recess therein;

(b) an additive tank configured to nest in said recess of said main water tank and defining an additive chamber and which, when nested in said recess, generally completes said cylindrical shape;

(c) wherein said water tank and said additive tank are formed from a non-metallic material comprising a polymeric component;

(d) wherein said water tank and said additive tank include integral external liquid level indicators;

(e) a mounting system for attaching said split tank system to a transit concrete mixing vehicle chassis; and (f) a plurality of strengthening ribs along said main water tank.

15. An on-board auxiliary split tank system for supplying makeup water and chemical additives to a transit concrete mixing vehicle comprising:

(a) a generally cylindrical main water tank designed for generally horizontal deployment defining a water compartment and having a shaped external recess therein;

(b) an additive tank configured to nest in said recess of said main water tank and defining an additive chamber and which, when nested in said recess, generally completes said cylindrical shape;

(c) wherein said water tank and said additive tank are formed from a non-metallic material comprising a polymeric component;

(d) wherein said water tank and said additive tank include integral external liquid level indicators;

(e) a mounting system for attaching said split tank system to a transit concrete mixing vehicle chassis; and (f) wherein said mounting system further comprises a pair of spaced mounting saddles for carrying said split tank system disposed in a generally horizontal posture and strap devices for removably attaching said split tank system to said saddles and retaining said additive tank in said recess.

16. A tank system as in claim 15 wherein said straps are of a polymeric material.

* * * * *